US006219950B1

(12) United States Patent
Hsu

(10) Patent No.: US 6,219,950 B1
(45) Date of Patent: Apr. 24, 2001

(54) PHOTO FRAME WITH MINI-FAN

(76) Inventor: Chin-Tien Hsu, No. 3, Alley 15, Lane 54, Fu-Te 2nd Rd., Hsichih, Taipei (TW)

( * ) Notice: Subject to any disclaimer, the term of this patent is extended or adjusted under 35 U.S.C. 154(b) by 0 days.

(21) Appl. No.: 09/415,054

(22) Filed: Oct. 12, 1999

(51) Int. Cl.[7] ..... A47G 1/06
(52) U.S. Cl. ..... 40/725; 40/745
(58) Field of Search ..... 40/700, 714, 715, 40/725, 748, 781, 745; D6/300

(56) References Cited

U.S. PATENT DOCUMENTS 922,715 * 5/1909 Munster ..... 40/725 X
5,547,343 * 8/1996 Jane et al. ..... 416/246
5,657,563 * 8/1997 Lane ..... 40/714 X
5,833,534 * 11/1998 Lai ..... 416/55 X
5,933,996 * 8/1999 Chang ..... 40/748

* cited by examiner

*Primary Examiner*—Brian K. Green
(74) *Attorney, Agent, or Firm*—Birch, Stewart, Kolasch & Birch, LLP

(57) ABSTRACT

A photo frame comprises a frame member, a mini-fan pivotably mounted on a side of the frame, and a battery case pivotably mounted on a position abutted against an opposite side of the frame for providing power to the mini-fan and supporting frame so as to enable pivotable adjustment of the mini-fan and battery case in response to a vertically or horizontally standing photo frame.

8 Claims, 6 Drawing Sheets

PHOTO FRAME WITH MINI-FAN

FIELD OF THE INVENTION

The present invention relates to a photo frame, and more particularly to a photo frame with mini-fan having a battery case as a support.

BACKGROUND OF THE INVENTION

A photo frame is used as a means for exhibit photograph (s). Many people like to place a photograph in a frame which is put on a suitable place, for example a table for viewing. Typically, a photo frame is a rectangular or square form having an opening formed therein for receiving photograph (s), and preferably a collapsible stand for supporting frame. Generally, in view of all commercially available photo frames, the only difference between different photo frames is their appearance. In other words, the only purpose of photo frame is, as stated above, for exhibit photograph(s) among various designs. Thus, it is desirable to see a photo frame with functions more than above.

SUMMARY OF THE INVENTION

It is therefore an object of the present invention to provided a photo frame with a mini-fan for providing an additional cooling capability having a battery case serving as a supporting means. The advantages of the present invention are realized by providing a photo frame comprising a frame, a mini-fan pivotably mounted on a side of frame, and a battery case pivotably mounted on a position abutted against an opposite side of frame for providing power to the mini-fan and supporting frame so as to enable to pivotably adjust the mini-fan and battery case in response to a vertically or horizontally standing photo frame. This further eliminates a support component as generally required by a conventional photo frame.

The above and other objects, features and advantages of the present invention will become apparent from the following detailed description taken with the accompanying drawings which are given by way of illustration only, and thus are not limitative of the present invention.

DETAILED DESCRIPTION OF PREFERRED EMBODIMENTS

Figure 1:
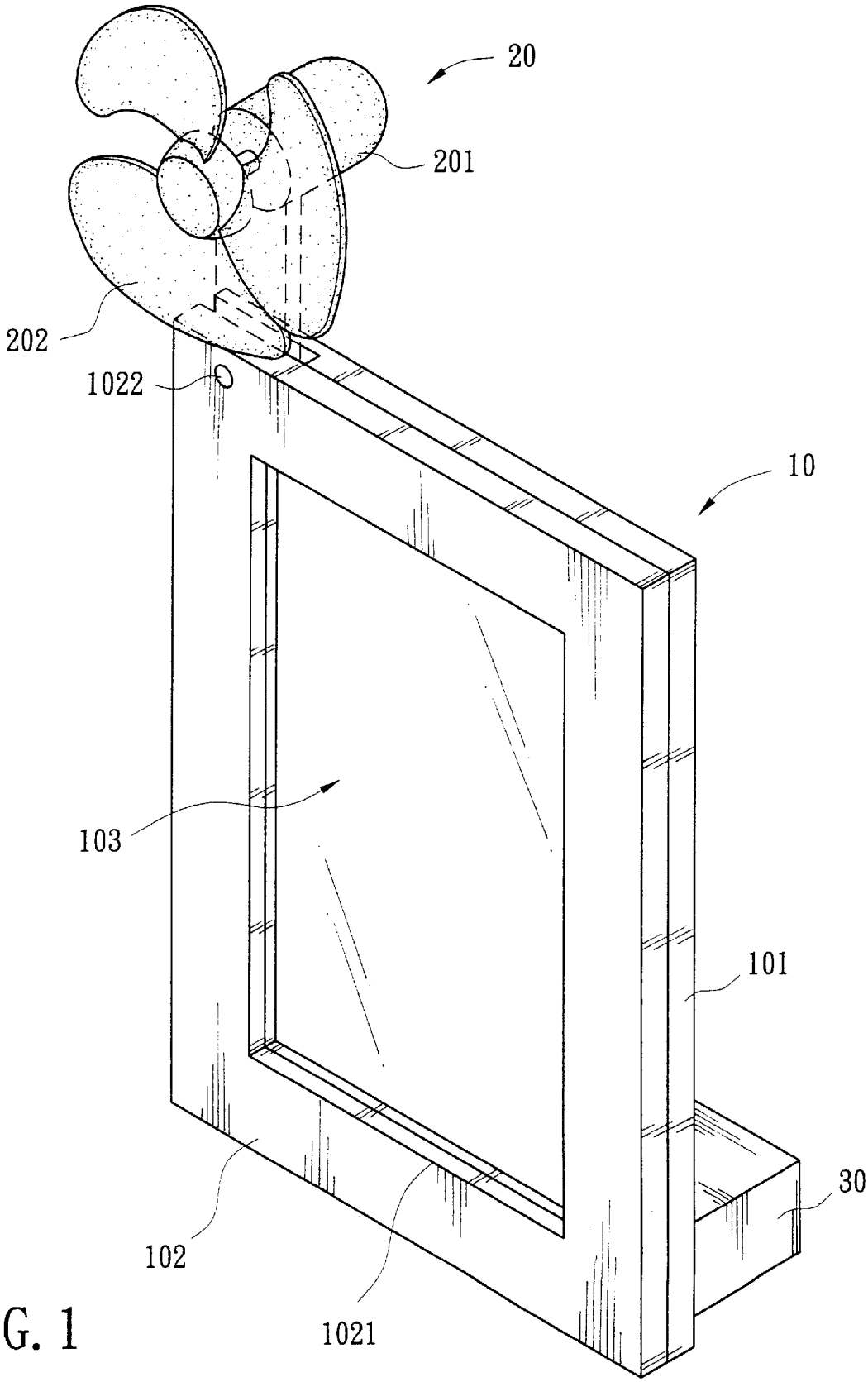
FIG. 1 is a front perspective view of the present invention.
Figure 2B:
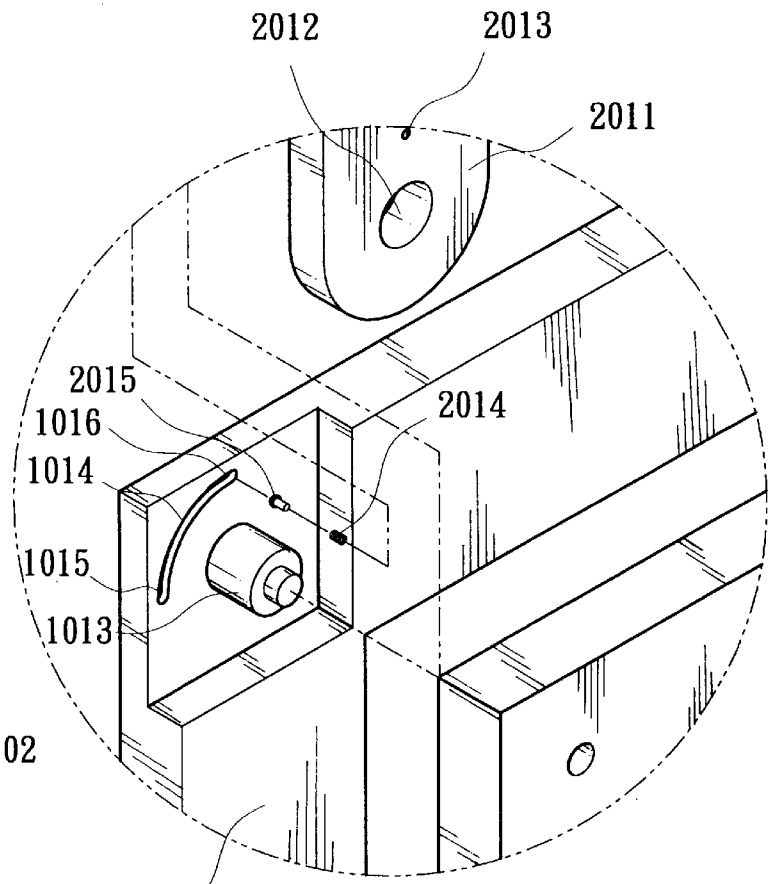
FIG. 2B is an enlarged view of portion enclosed by dashed line of FIG. 2A for clearly illustrating the relative position of mini-fan with frame.
Figure 2A:
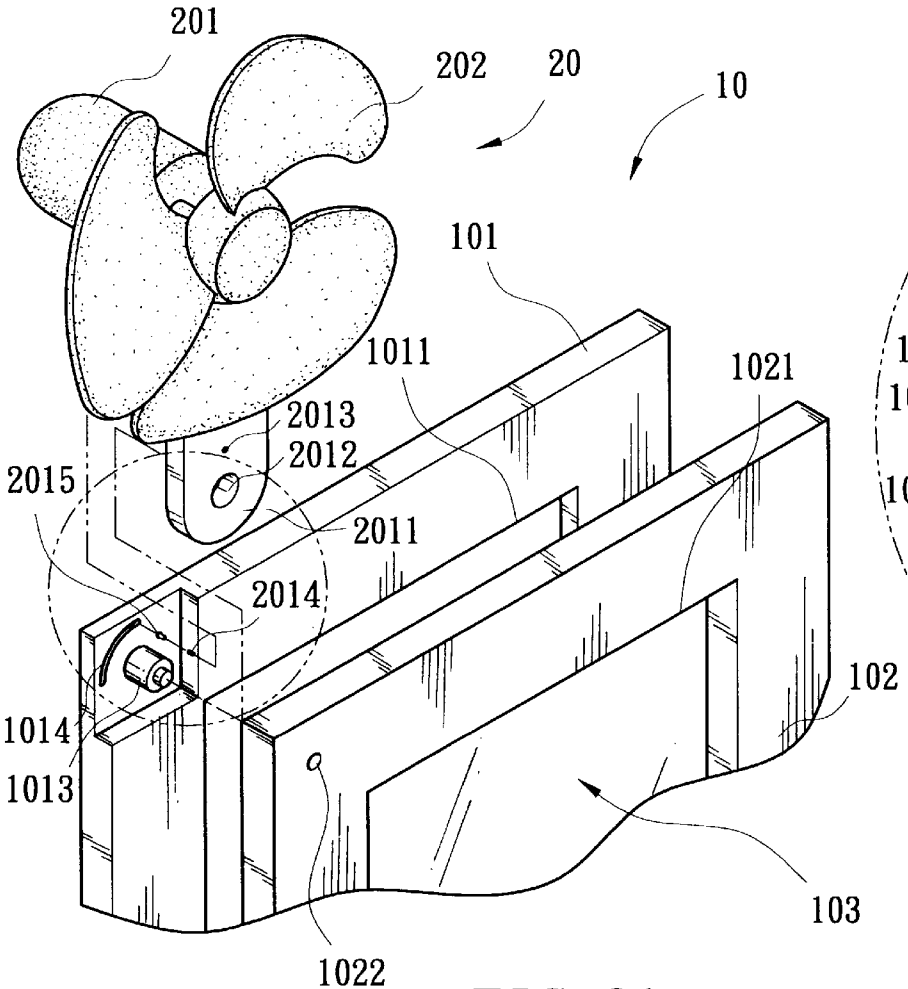
FIG. 2A is a partial view of FIG. 1 with mini-fan separated.

Referring to FIGS. 1, 2A, and 2B, there is shown a photo frame constructed according to the invention comprising a frame 10, a mini-fan 20, and a battery case 30. Frame 10 comprises a first frame member 101 and a second frame member 102. A rectangular or square opening 103 is formed in the space enclosed by first frame member 101 and second frame member 102. First frame member 101 has an opening 1011. Photograph(s) (not shown) may be put into opening 103 through opening 1011. An axis 1013 is provided on, for example a square recess on a corner of first frame member 101. An arcuated groove 1014 preferably having a semicircular cross section is provided adjacent to axis 1013 on first frame member 101. Groove 1014 has two further recessed portions 1015 and 1016 formed on two ends. Second frame member 102 has a window 1021 for viewing photograph(s). A cover (not shown) made of a transparent material, such as glass, acrylic may be provided on window 1021 for protecting the photograph(s). A hole 1022 corresponding to axis 1013 is provided on second frame member 102 for permitting axis 1013 to be received therein when first frame member 101 and second frame member 102 are engaged together.

Mini-fan 20 comprises a motor 201 and a number of blades 202 (three blades are shown). Motor 201 is a well-known device for driving blades 202 to provide a cooling effect to user. A projection 2011 is downwardly extended from mini-fan 20 in which a hole 2012 is provided on the lower center portion of projection 2011 for receiving axis 1013 when mini-fan 20 is mounted on first frame member 101. Note that projection 2011 should have a sufficient length for permitting to rotate a limited range about axis 1013 on the corner of frame 10, i.e., blades 202 can not contact with frame 10 when mini-fan 20 is operating.

Figure 3:
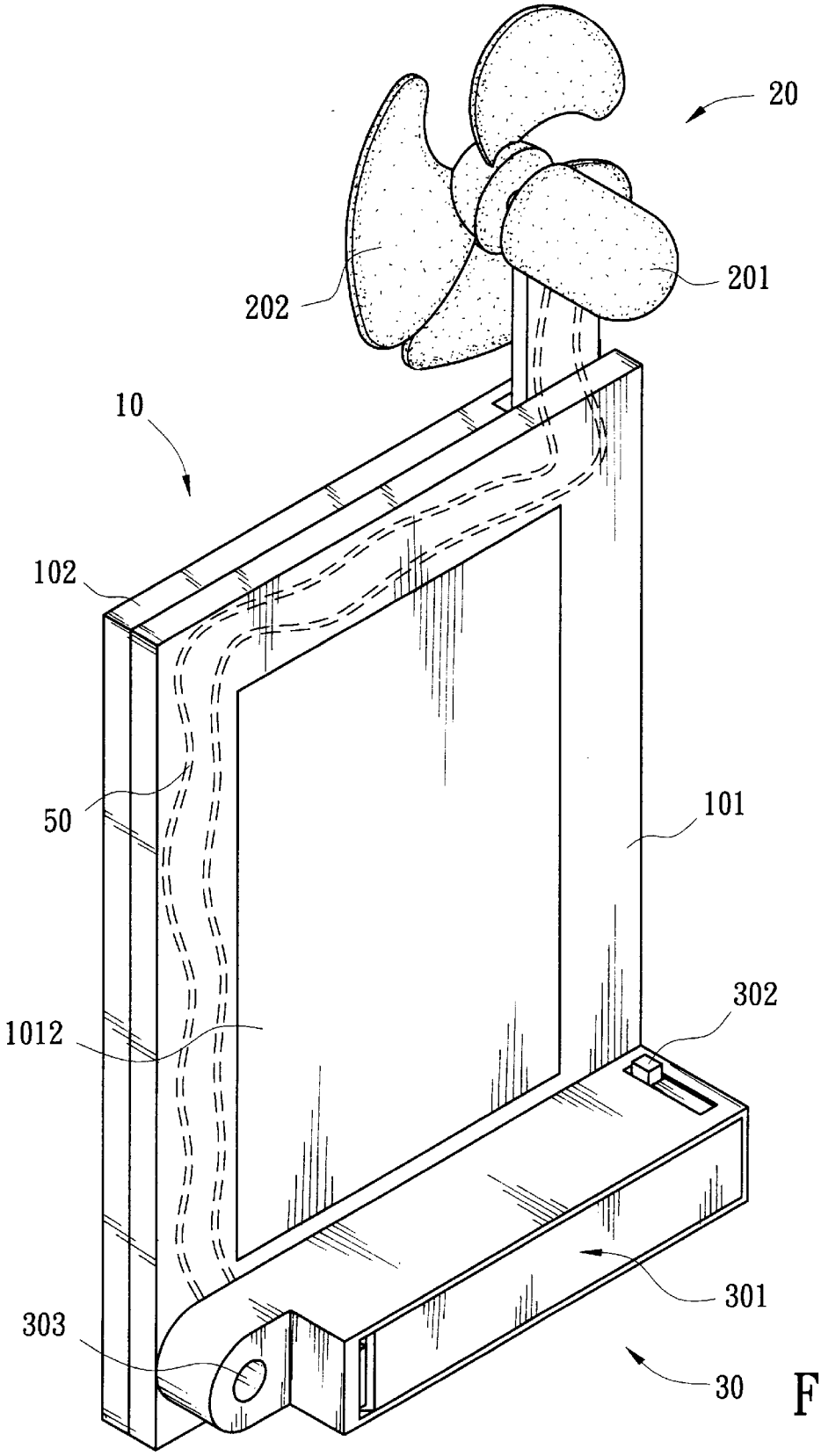
FIG. 3 is a rear perspective view of FIG. 1 with dashed line showing an electrical connection between mini-fan and battery case.

Referring to FIG. 3, a releasable back cover 1012 is provided on opening 1011 for allowing to insert a photograph into frame 10 or to take the photograph up. Battery case 30 is provided on a position abutted against a side opposing to the side where the mini-fan 20 mounted. An axis 303 pivotably secures battery case 30 and frame 10 together on an end of battery case 30 such that the attached battery case 30 can serve as a stand for frame 10 by its own weight when fame 10 is laid on a supporting plane. Battery case 30 has a compartment 301 for receiving one or more batteries (not shown). The driving source of mini-fan 20 is provided by battery case 30 through a cord 50. Preferably, cord 50 is embedded within first frame member 101 for not detracting from frame's 10 external appearance.

Battery case 30 also has a switch 302 for turning on or off mini-fan 20. In brief, battery case 30 is both a drive source of mini-fan 20 and a supporting means to frame 10.

Figure 4:
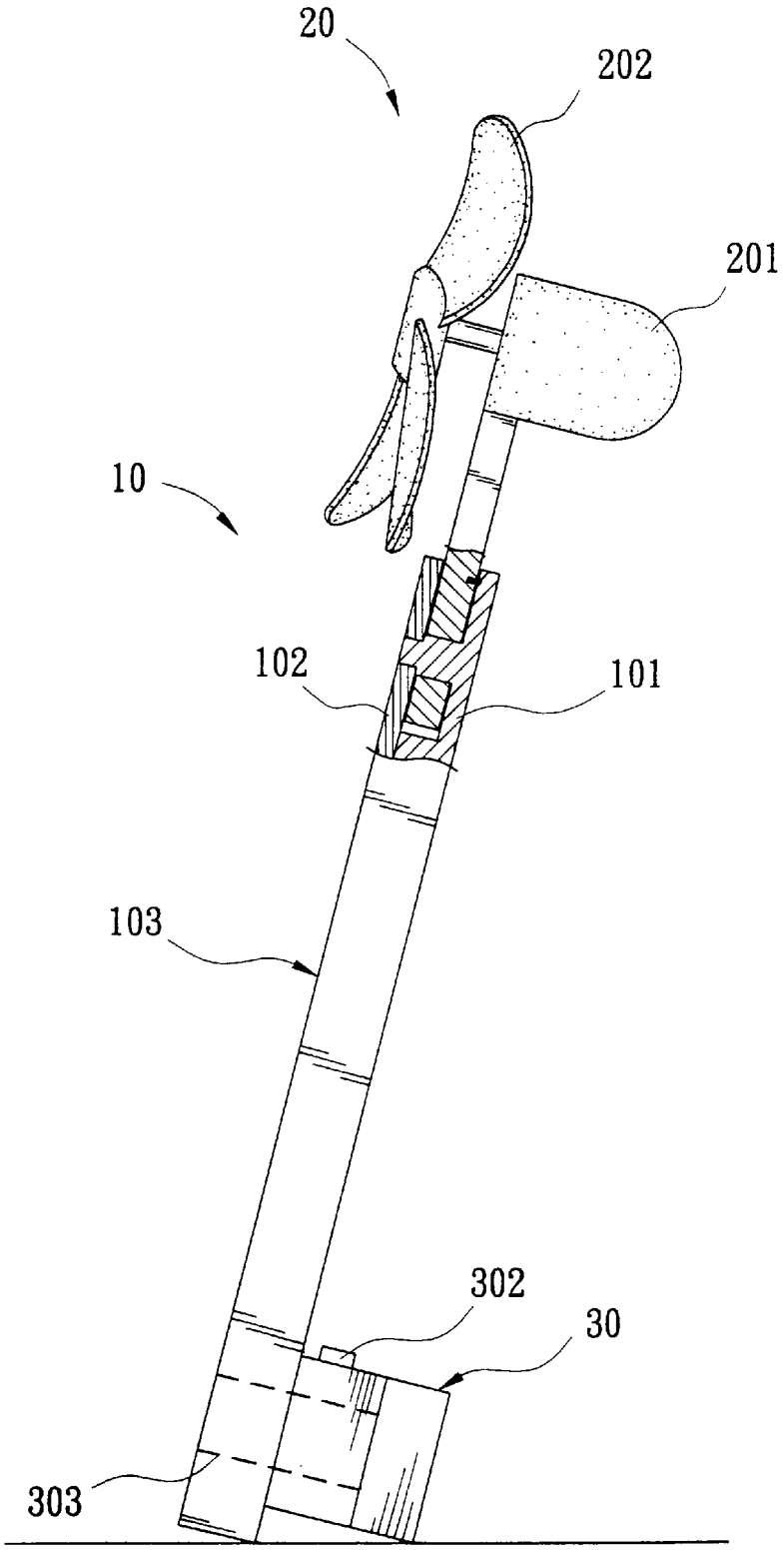
FIG. 4 is a side sectional view of FIG. 1.
Figure 5:
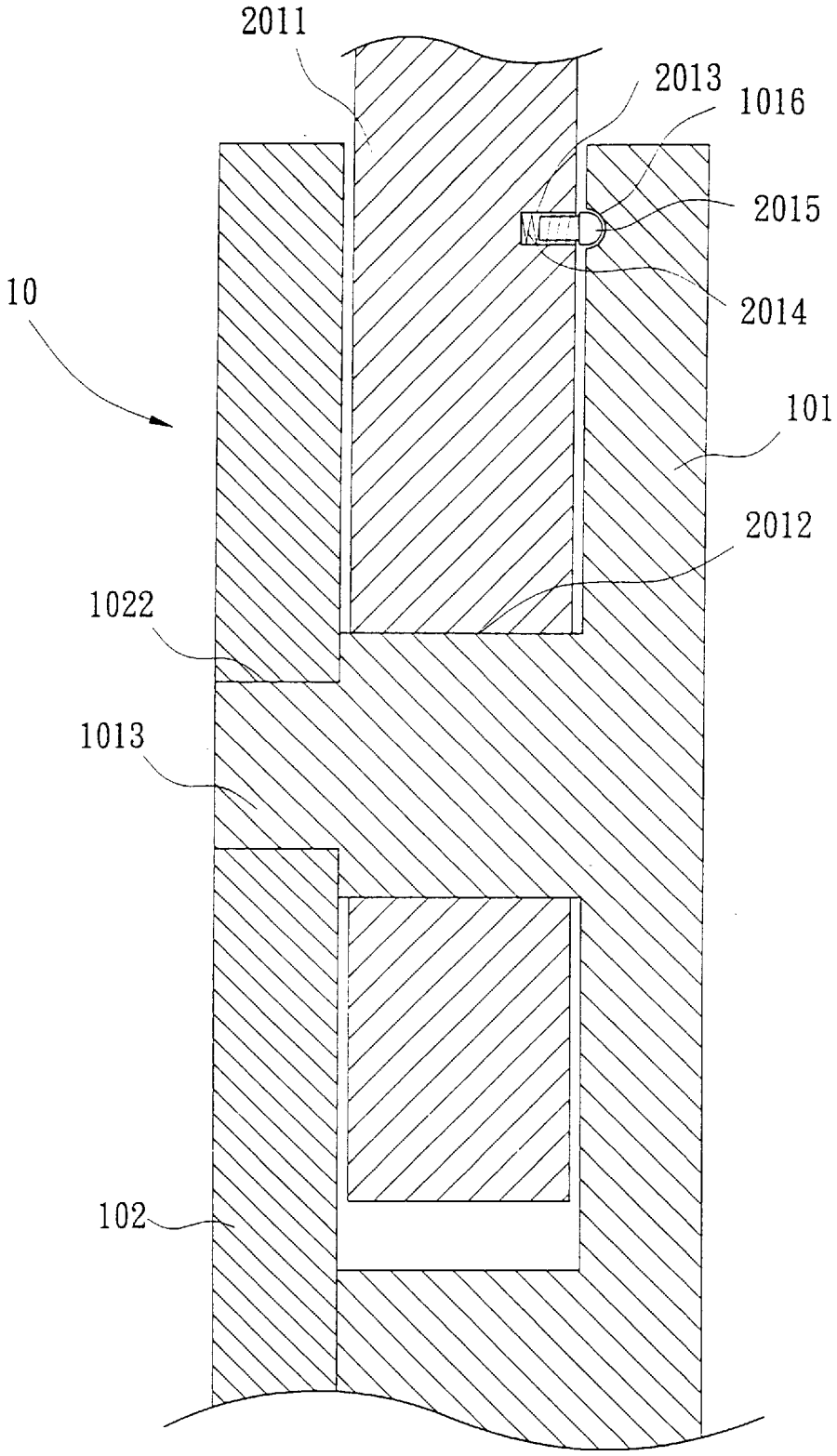
FIG. 5 is an enlarged view of shaded area of FIG. 4.

Referring to FIGS. 2B, 4, and 5, a recess 2013 corresponding to further recessed portions 1015 and 1016 of projection 2011 is formed on top of hole 2012. A helical spring 2014 is mounted in recess 2013 with one end engaged against bottom of recess 2013. A locking pin 2015 is inserted into spring 2014 with the head protruded from surface of projection 2011. Locking pin 2015 is slidably movable along groove 1014. Mini-fan 20 is firmly secured to frame 10 when head of locking pin 2015 is moved into recessed portion 1015 or 1016 (see FIG. 5). Note that it is possible to form more than two further recessed portions equally spaced along groove 1014 in order to allow a multiple relatively positioning of mini-fan 20 to frame 10.

We understand that a photograph can be vertically or horizontally put on photo frame depends on the orientation of photograph. Accordingly, a photo frame may vertically or horizontally stand on a supporting plane. This means that supporting means (i.e., battery case 30) and mini-fan 20 have to change their orientations in response to a changed standing position of photo frame.

Figure 6:
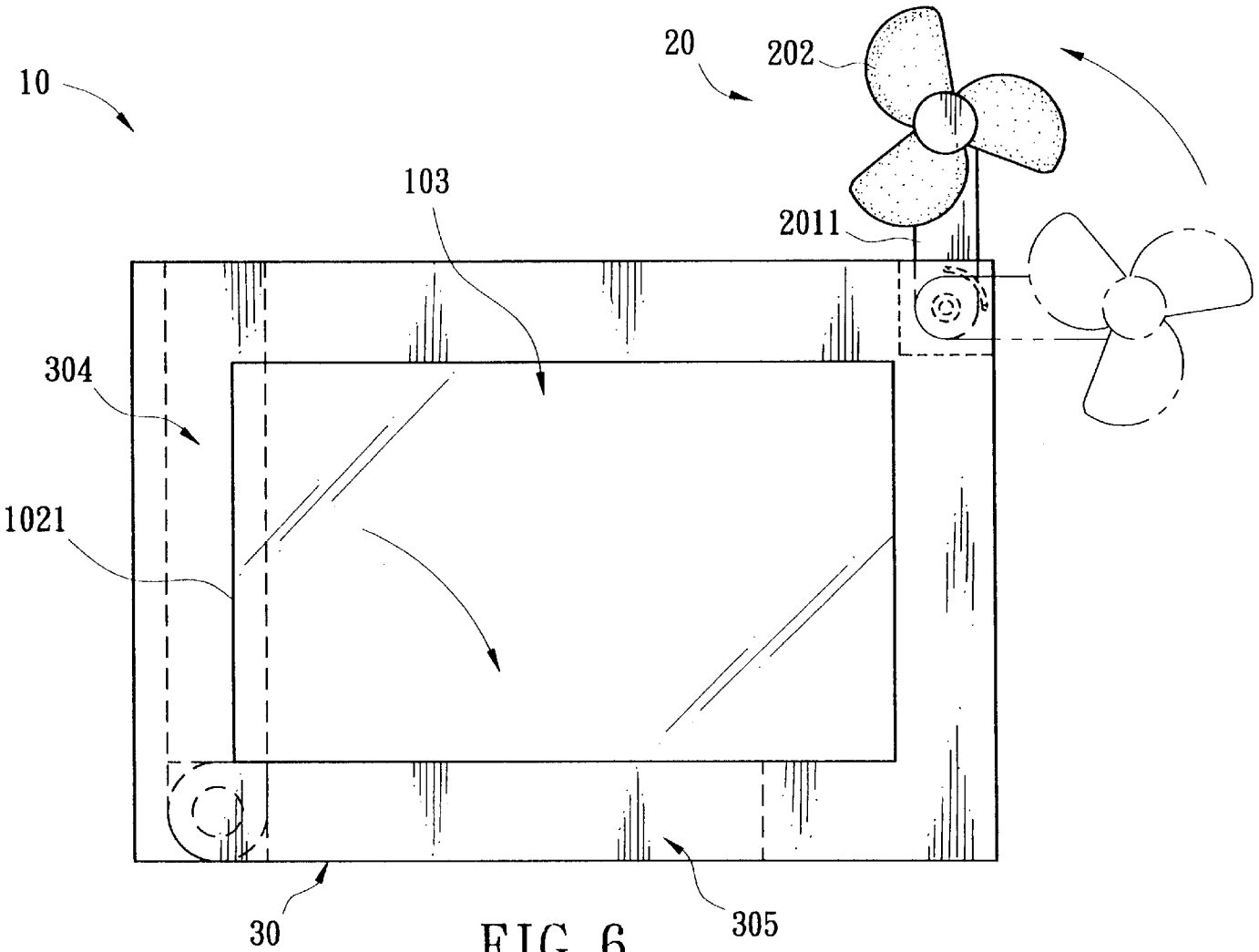
FIG. 6 is a plan view illustrating a vertically and horizontally standing photo frame.

Referring to FIGS. 1 and 6, two orientations of photo frame are provided respectively in which one is a portrait position (FIG. 1) and the other is a landscape position (FIG. 6). As stated above, mini-fan 20 and battery case 30 both are pivotably mounted on frame 10. In other words, mini-fan 20 can be adjusted to an appropriate position in response to a changed orientation of photo frame as indicated by arrow, while battery case 30 also can be moved from first operating position 304 to second operating position 305 for providing a necessary support to frame 10.

While many advantages of the invention, such as providing a cooling mini-fan as well as eliminating a support component as conventionally required by utilizing battery case as a stand has been described by means of specific embodiments, numerous modifications and variations could be made thereto by those skilled in the art without departing from the scope of the invention set forth in the claims.

What is claimed is:

1. A photo frame comprising:

a frame member having a first opening formed in a space enclosed by the frame member for receiving one or more photographs;

a mini-fan having a projection extending downwardly therefrom, a first hole being provided in the projection; and a battery case having a compartment for receiving one or more batteries, the battery case and frame member being pivotably secured together at an end of the battery case such that the battery case can serve as a stand for the frame member when the frame member is laid on a supporting plane, wherein the battery case and the frame member can be positioned in a first operating position and a second operating position respectively.

2. The photo frame of claim 1, wherein the frame member comprises a first frame member and a second frame member, the first frame member having a releasable back cover for inserting photographs into the first opening, and the second frame member having a window thereon.

3. The photo frame of claim 2, wherein the mini-fan is pivotably mounted on a corner of the first frame member and wherein an arcuate groove is provided adjacent to a pivot axis between the mini-fan and the first frame member.

4. The photo frame of claim 3, wherein the arcuate groove has two recessed portions formed on two ends thereof.

5. The photo frame of claim 4, further comprising a resilient locking pin slidably movable along the groove and firmly secured to the first frame member when the locking pin is received in one of the recessed portions.

6. The photo frame of claim 2, wherein the second frame member has a hole receiving a shaft about which the mini-fan pivots.

7. The photo frame of claim 1, wherein the mini-fan comprises a plurality of blades and a motor for driving the blades.

8. The photo frame of claim 1, wherein the battery case comprises an on-off switch.

* * * * *